US010946267B2

(12) United States Patent
Pater et al.

(10) Patent No.: US 10,946,267 B2
(45) Date of Patent: Mar. 16, 2021

(54) SEVEN-FACE GAMING DIE WITH EQUAL PROBABILITY

(71) Applicant: Jacobus Alton, Littleton, CO (US)

(72) Inventors: Teresa M. Pater, Littleton, CO (US); Jacobus Alton, Littleton, CO (US)

( * ) Notice: Subject to any disclaimer, the term of this patent is extended or adjusted under 35 U.S.C. 154(b) by 0 days.

(21) Appl. No.: 16/009,602

(22) Filed: Jun. 15, 2018

(65) Prior Publication Data

US 2018/0361229 A1 Dec. 20, 2018

Related U.S. Application Data

(60) Provisional application No. 62/603,988, filed on Jun. 16, 2017.

(51) Int. Cl.
*A63F 9/04* (2006.01)
*A63F 9/24* (2006.01)

(52) U.S. Cl.
CPC .... *A63F 9/0415* (2013.01); *A63F 2009/0428* (2013.01); *A63F 2009/0484* (2013.01); *A63F 2009/0488* (2013.01); *A63F 2009/0497* (2013.01); *A63F 2009/2435* (2013.01)

(58) Field of Classification Search
CPC ..... A63F 9/0415; A63F 2009/0428; A63F 2009/0471; A63F 2009/0484; A63F 2009/0486
USPC ..... 273/146
See application file for complete search history.

(56) References Cited

U.S. PATENT DOCUMENTS 1,563,680 A * 12/1925 Zwirner ..... A63F 3/00041 273/247
D155,315 S * 9/1949 Peukert ..... D21/373
3,198,523 A * 8/1965 Stimson ..... A63F 9/0415 273/146
3,400,932 A * 9/1968 Conrad ..... A63F 9/0413 273/146
3,608,905 A * 9/1971 Edison ..... A63F 1/16 273/146
3,655,197 A * 4/1972 Milbaum ..... A63F 5/04 273/146
3,931,971 A * 1/1976 Harvey ..... A63F 9/0278 473/595
4,055,348 A * 10/1977 Marzoni, Jr. ..... A63F 9/0098 273/146
4,546,978 A * 10/1985 David ..... A63F 9/0415 273/146
4,989,875 A * 2/1991 Capy ..... A63F 9/0415 273/146
5,018,738 A * 5/1991 Padi ..... A63F 9/0415 273/146

(Continued)

FOREIGN PATENT DOCUMENTS

DE 860162 C * 12/1952 ..... A63F 9/0415
EP 0327477 A2 * 8/1989 ..... A63F 9/0415
GB 191016142 A * 4/1911 ..... A63F 9/0415

*Primary Examiner* — William M Pierce
(74) *Attorney, Agent, or Firm* — Todd N. Hathaway; Harold H. Bennett, II

(57) ABSTRACT

A gaming die is provided, that has a generally spherical body and a plurality of substantially planar faces distributed around the die. The spherical body defines lands extending between pairs of the plurality of faces. A plurality of bosses positioned on the spherical body between respective pairs of the plurality of faces.

11 Claims, 8 Drawing Sheets

(56) References Cited

U.S. PATENT DOCUMENTS

| | | | | | |
|---|---|---|---|---|---|
| 5,511,782 | A * | 4/1996 | Maley | A63B 43/002 | 273/146 |
| 5,556,096 | A * | 9/1996 | Eardley | A63F 9/0415 | 273/146 |
| 5,839,725 | A * | 11/1998 | Conway | A63F 3/00028 | 273/244 |
| 5,918,881 | A * | 7/1999 | Kirby | A63F 9/0415 | 273/146 |
| 5,947,741 | A * | 9/1999 | Villarreal | A63F 9/0415 | 434/159 |
| 6,109,608 | A * | 8/2000 | Golad | A63F 7/0076 | 273/146 |
| 6,926,276 | B1 * | 8/2005 | Zocchi | A63F 9/0415 | 273/145 CA |
| 8,074,986 | B1 * | 12/2011 | Gebhart | A63F 9/0415 | 273/146 |
| D729,326 | S * | 5/2015 | Martyn | D21/707 | |
| 2003/0168802 | A1 * | 9/2003 | Hsu | A63F 9/0415 | 273/139 |
| 2004/0041342 | A1 * | 3/2004 | Frieman | A63F 9/0415 | 273/146 |
| 2005/0070350 | A1 * | 3/2005 | McVay, III | A63F 9/0098 | 463/7 |
| 2017/0333782 | A1 * | 11/2017 | Fjelstad | A63F 9/0415 | |
| 2018/0008885 | A1 * | 1/2018 | Antohi | A63F 9/0415 | |
| 2018/0104572 | A1 * | 4/2018 | Bergant | G07F 17/3213 | |
| 2018/0304148 | A1 * | 10/2018 | Blanco | A63F 9/0415 | |

* cited by examiner

SEVEN-FACE GAMING DIE WITH EQUAL PROBABILITY

BACKGROUND

Technical Field

This disclosure relates generally to dice used in playing games, and more specifically to dice having numbers of faces other than six.

Description of the Related Art

There are many examples of dice with numbers of faces other than the common six-faced die. Typically, dice, whatever the number of faces, are defined by a number identical of planar faces separated by straight edges, and corners where those edges meet. While in some cases the edges and/or corners of a die may be somewhat rounded, the planar faces occupy nearly all of the surface area, and the rounded portions do little more than increase the rolling time of the die, without affecting its function, as compared to a similar die on which the edges and corners are sharp.

The most commonly used die shapes are the five platonic solids, of which the standard six-sided cube is one. The other four platonic solids are the tetrahedron (four sides), the octahedron (eight sides), the dodecahedron (twelve sides), and the icosahedron (twenty sides). Every face of a platonic solid is an identical regular polygon, and in cases of rolling any version of a platonic solid die for the purpose of gaming, the traditional method of registering the "count" upon completion of the roll is determined by the character, number or symbol on the settled die's uppermost face. Other die shapes are occasionally used, usually regular bipyramids or symmetric icosahedra. In both of these classes of shapes, each of the faces of a given example is an identical polygon—though not necessarily a regular polygon—and the number of faces is even.

A particular characteristic of four of the five platonic solids—the tetrahedral being the exception—is that for every face there is a face on the opposite side of the die that lies in a parallel plane meaning that when the die is tossed and comes to rest on any one of its faces there will always be an uppermost face lying parallel to the surface on which the die rests. This is also true of all other even-number-faced dice of which the inventor is aware. Typically, when rolling a die the "count" of the die is determined by the character number or symbol on the settled die's uppermost face.

Dice having odd numbers of faces are extremely rare, and are usually of types referred to as long dice or barrel dice (a variant form of long dice). Such dice have a number of long, narrow, rectangular faces that meet along their long edges and extend around the circumference of the die. The small ends are sometimes rounded or pointed, to prevent the die from landing on an end. Most importantly relative to utilizing dies with odd numbers of faces for the purpose of gaming is the inconclusive nature of determining the count to the mutual satisfaction of all the participants of such a game, since no particular face of such die can settle upon completion of a roll in such a way as to clearly be uppermost of the die's odd number of faces.

The elongate, spindle-shaped form allows long dice to employ an odd number of identical faces which gives the appearance of randomness. However, the shape is regular only with respect to the long axis. Consequently, when tossed by hand, long dice do not/tumble and roll in an even manner like ordinary dice having regular, isogonal shapes, but instead tend to bounce end-to-end depending on the angle at which they strike the playing surface, the force with which they are thrown, and other factors. Not only does this effect strike many players as both unpleasant and suspicious, but it is conceivable that persons might in fact develop the ability to manipulate these variables to achieve non-random results.

Another issue with respect to all odd-number-face dice in gaming is the ambiguity of the count of a tossed die, inasmuch as none of the faces can be uppermost and all parallel to the gaming surface. The count may be determined based on the number on the bottom-most face which faces downward, but to read the count a player must pick up and invert the die, which in turn presents an opportunity for cheating or for accidental changing of the count.

SUMMARY OF THE INVENTION

The present invention provides gaming dice and a method for construction thereof, wherein the dice have seven or another odd number of flat faces distributed about the surface of a body such that when tossed the dice roll and achieve a random count approximating that which is produced by ordinary dice having cubic or other regular polyhedronal shapes.

The body of a die constructed in accordance with the present invention may comprise a generally spherical body. Planar faces of the die may be positioned on the spherical body at locations calculated utilizing a spherical coordinate system. The generally spherical body may comprise first and second hemispheres, with "n" planar faces being positioned at spaced apart locations on the first hemisphere and "n+1" planar faces being positioned at spaced apart locations on the second hemisphere, wherein "n" is an integer. "n" may equal three, for a total of seven faces. Rounded bumps or other protrusions may be included at locations generally intermediate to the planar faces on the second hemisphere, to interrupt straight rolling paths across the intervening surface areas and thereby enhance the production of random results by the dice.

At least one of the pluralities of planar faces may include an inidicium displayed thereon. The plurality of planar faces may display separately distinguishable indicia thereon, such as numeric or other symbols.

In an embodiment, the pluralities of planar faces distributed about the generally spherical body of the die may consist of seven planar faces. Three of the seven faces may be located on the first hemisphere of body and four of the seven faces may be located on the second hemisphere of the body. The locations of the faces may be identified by a geographic coordinate system considering the two hemispheres as defining an equator and north and south poles, with latitudes and longitudes determined therefrom.

The three faces on the first hemisphere may be centered on longitudes spaced 120° around said spherical body and on a first latitude spaced from the equator of the spherical body. The first of the four faces on the second hemisphere may be centered on the pole of the hemisphere and the remaining three faces may be centered on longitudes spaced 120° around the spherical body and on a second latitude spaced from the equator of the body, and the longitudes on which the three spaced faces on the second hemisphere being offset 60° from the longitudes on which the three faces of the first hemisphere are centered and the latitudes on which the three spaced faces of the first hemisphere are centered being greater than that on which the three spaced faces of the second hemisphere are located.

Protrusions may be located on the blank lands intermediate the three spaced faces on the second hemisphere, to interrupt direct rolling of the body across the lands and thereby increase production of random results by the dice for playing purposes. The raised protrusions may be low, domed bumps and may be centered on the same longitudes on which the spaced faces of the first hemisphere are centered and on a third latitude spaced from the equator of the spherical body. The first latitude on which the faces of the first hemisphere are centered may be about 23° from the equator, the second latitude on which the three spaced faces on the second hemisphere are centered may be about 12° from the equator of the body, and the third parallel on which the three protrusions of the second hemisphere are centered may be about 43° from the equator.

These and other features and advantages of the present invention will be more fully appreciated from a reading of the following detailed description.

DETAILED DESCRIPTION

Figure 1:
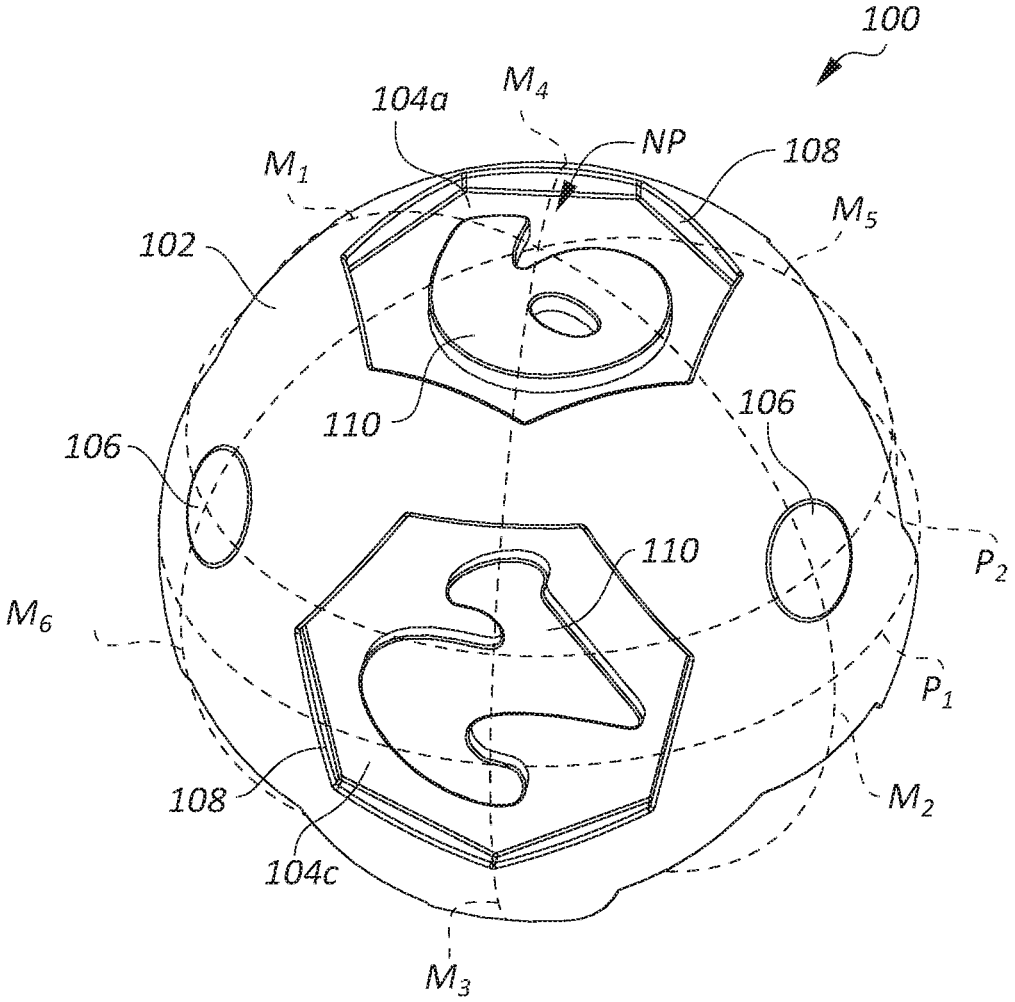
FIG. 1 is a perspective view of a seven-faced gaming die, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

As noted above, it is mathematically impossible to construct a die having certain odd rather than even numbers of sides and the shape of a regular polyhedron. The present invention provides for construction of dice having odd numbers of faces, but with a shape that enables the dice to roll and achieve a level a randomness approximating the results produced by regular polyhedronal dice when thrown in play. The odd number of faces (e.g., seven) is distributed over of a generally spherical body in accordance with the invention. The faces may be located on the body utilizing a spherical coordinate system.

Figure 2:
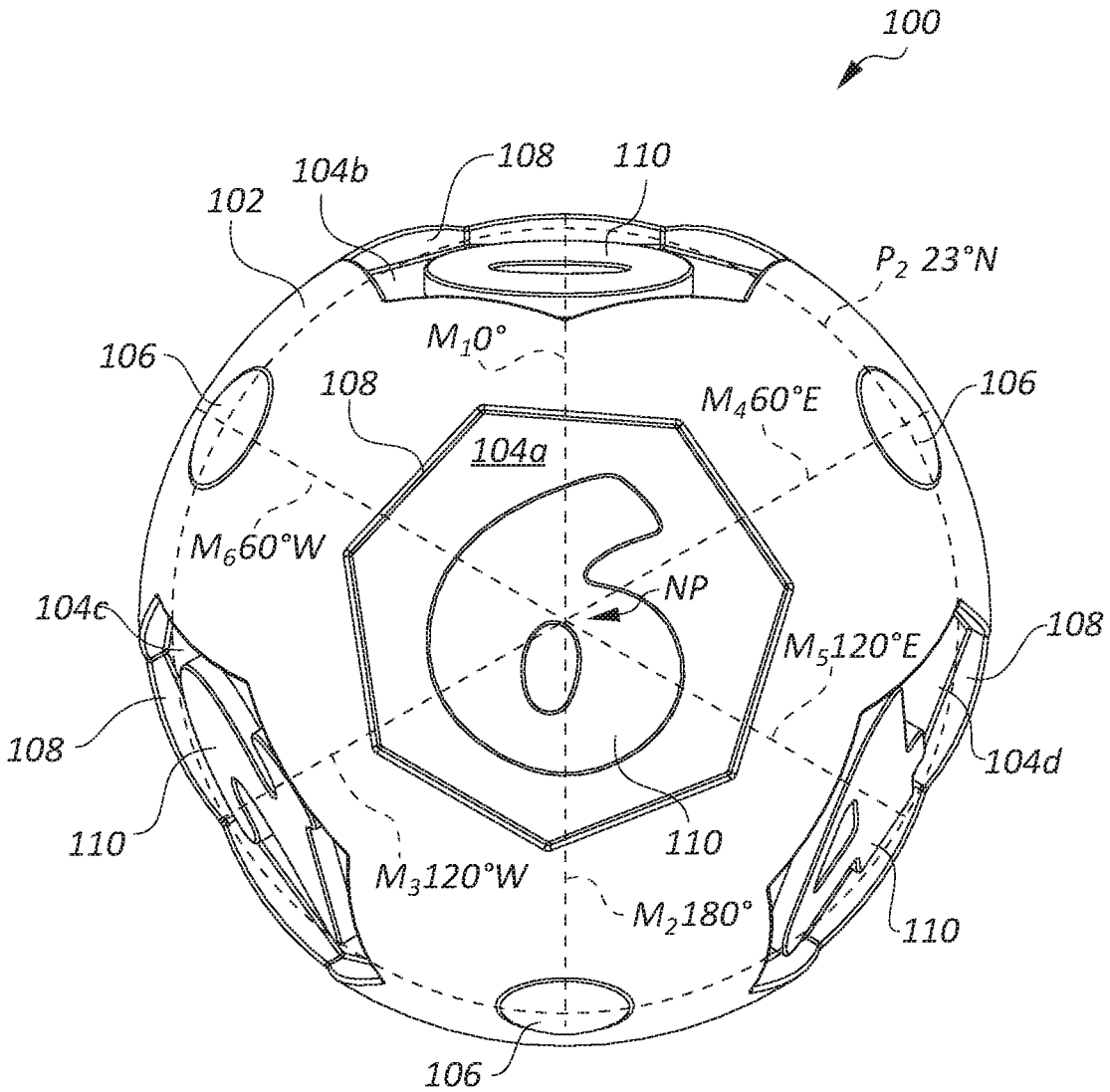
FIG. 2 is a top plan view of the gaming die of FIG. 1.
Figure 3:
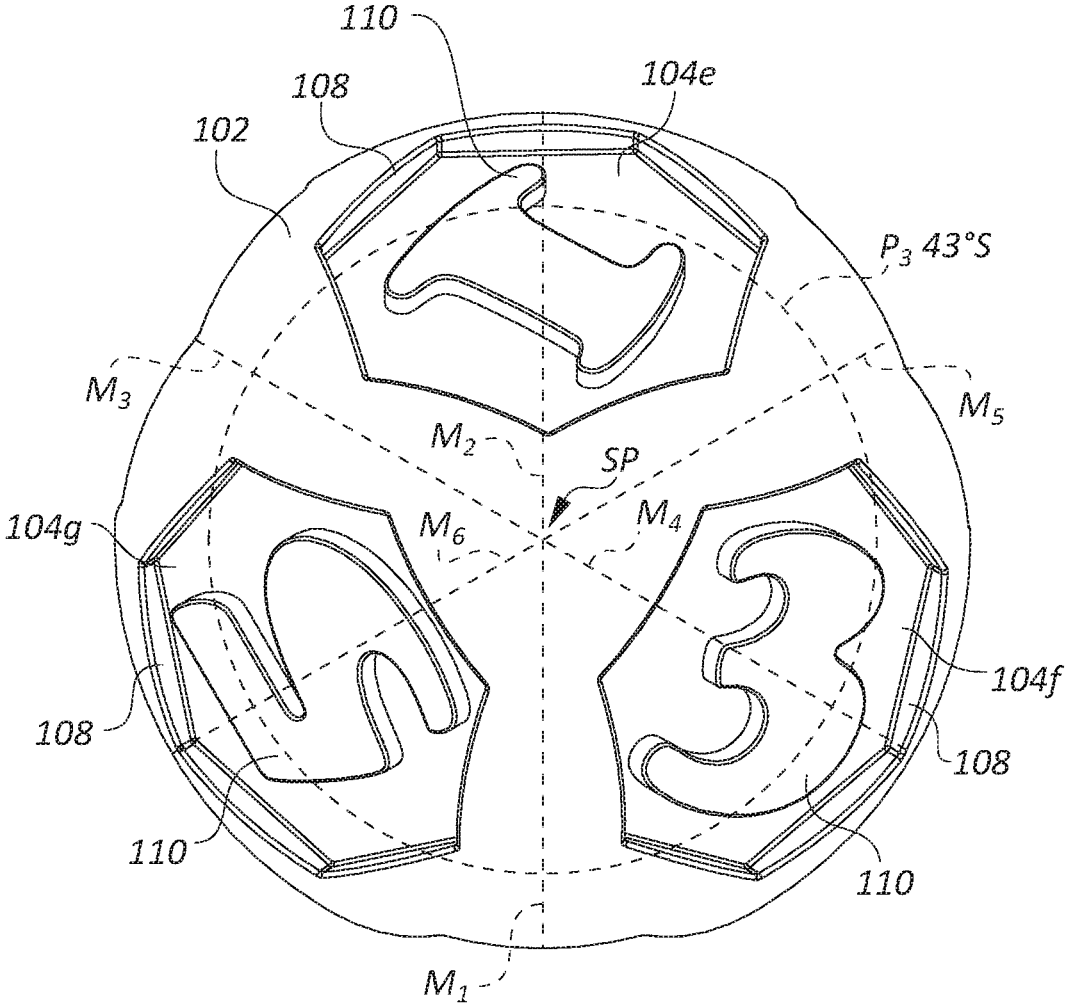
FIG. 3 is a bottom plan view of the gaming die of FIG. 1.
Figure 4:
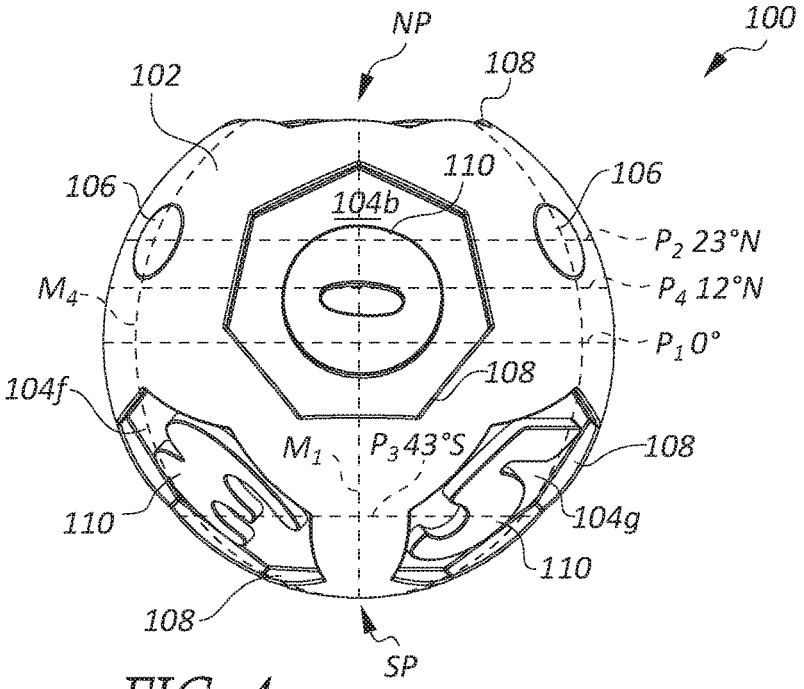
FIGS. 4-7 are respective side elevation views of the gaming die of FIG. 1.
Figure 8:
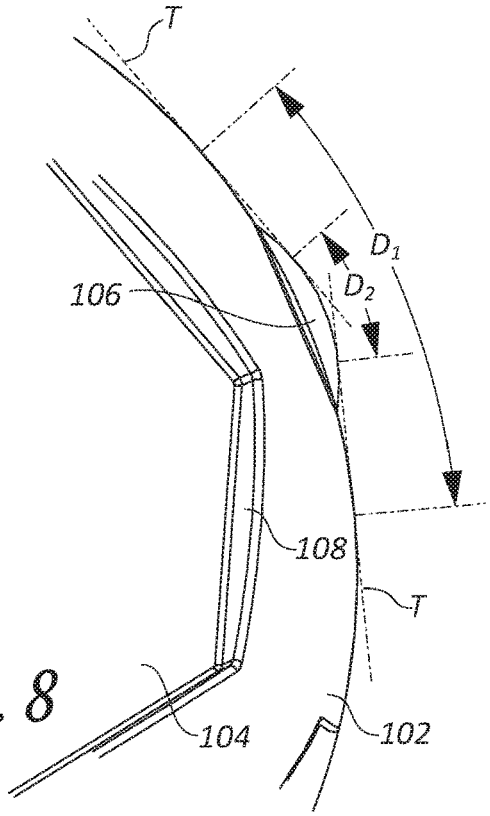
FIGS. 8 and 9 are enlarged views of a portion of the gaming die of FIG. 1, showing, respectively, side and plan views of a detail of the die.
Figure 9:
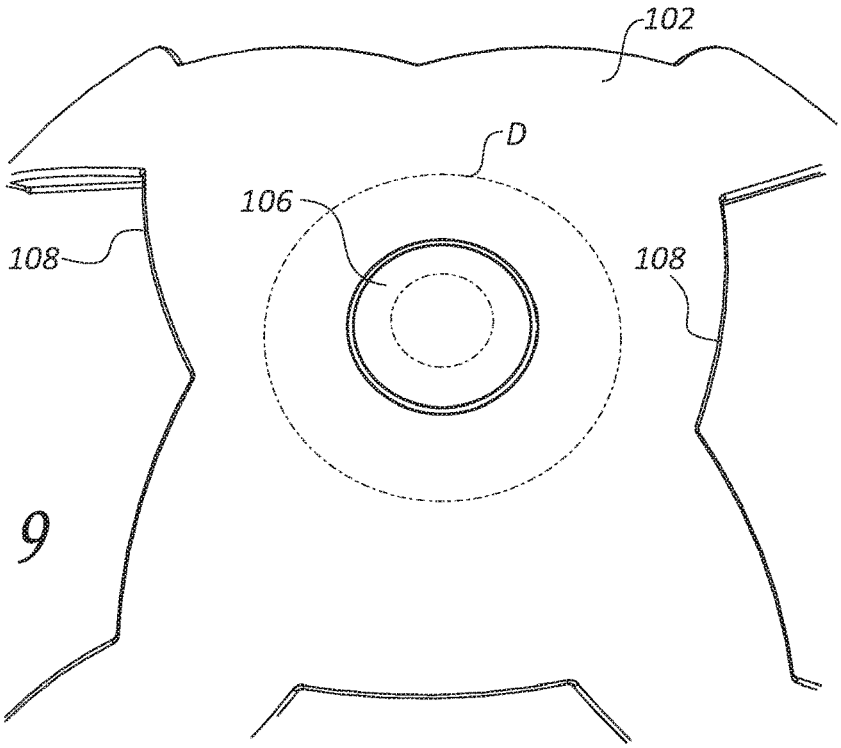

FIGS. 1-9 are consequently diagrams showing a gaming die 100, in respective views, according to an embodiment of the invention. FIG. 1 is a perspective view of the gaming die 100. FIG. 2 is a top plan view of the gaming die 100, looking down on the North pole NP of the die. FIG. 3 is a bottom plan view, looking up at the South pole SP of the die. FIGS. 4-7 are side elevations showing respective sides of the gaming die 100. FIGS. 8 and 9 are enlarged views of a portion of the gaming die 100.

For clarity and convenience, the gaming die 100 is described hereafter using a geographical coordinate system, in which positions on the die are defined by latitude and longitude, as will be explained in more detail below. North and South poles, as well as reference meridians are assigned arbitrarily. The use of such descriptive tools in the specification does not suggest or imply any necessary limitation to the inventions defined by the claims, which are limited only by their own language.

The die 100 includes a body 102 having a generally spherical shape, with a plurality of recesses, or faces 104 and bumps, or bosses 106 distributed over the body 102. Each of the faces 104 comprises a region that is recessed, relative to the surface of the spherical body 102, and is defined by side walls 108. In the embodiment shown, there are seven faces 104, each a regular seven-sided polygon of equal size.

In a preferred embodiment, the die 100 has a diameter of around 36 mm (about 1⅜"), and each of the faces can be circumscribed by a circle with a diameter of about 20 mm (slightly more than ¾").

Each face 102 lies in a plane that is normal to a-notional-radial line extending from the center of the spherical body 102 to a center of the respective face, and the side walls 108 of the face are parallel to the respective radial line. A respective distinguishing symbol 110 is positioned on each of the plurality of faces 104, enabling each face to be easily distinguishable from each of the remaining faces. In the embodiment described with reference to FIGS. 1-7, the symbols 110 are Arabic numerals 0-6. A few examples of embodiments employing other types of symbols are shown and described below with reference to FIGS. 10-12.

Latitude and longitude lines are provided in many of the drawings to more clearly show the relative positions of various elements of the gaming die 100, according to an embodiment. As best shown in the top and bottom plan views of FIGS. 2 and 3, six meridian lines $M_1$-$M_6$ meet together at the North and South poles NP, SP. The first meridian $M_1$ is arbitrarily designated the prime meridian, at 0° longitude. The second meridian $M_2$, directly opposite the first meridian, is at 180° longitude. The third and fourth meridians $M_3$, $M_4$ are at 120° West longitude and 60° East longitude, respectively, while the fifth and sixth meridians $M_5$, $M_6$ are at 120° East longitude and 60° West longitude, respectively. Additionally, as shown, particularly, in FIGS. 4-7, four parallels $P_1$-$P_4$ are shown. The first parallel $P_1$ is the equator, at 0° latitude, while the second, third, and fourth parallels are at 23° North latitude, 43° South latitude, and 12° North latitude, respectively.

A first face 104*a* is centered over the North pole NP. Second, third, and fourth faces 104*b*, 104*c*, and 104*d* are evenly spaced around the North pole and substantially within the Northern hemisphere, each centered over the fourth parallel $P_4$, at around 12 degrees North latitude. The second face 104*b* is also centered over the first meridian $M_1$ at 0 degrees longitude, while the third face 104*c* is centered over the third meridian $M_3$ at 120 degrees West longitude, and the fourth face 104*d* is centered over the fifth meridian $M_5$ at 120 degrees East longitude. The fifth, sixth, and seventh faces 104*e*, 104*f*, 104*g* are evenly spaced around the South pole, wholly within the southern hemisphere, each centered over the third parallel $P_3$, at around 43 degrees South latitude. The fifth face 104*e* is centered over the second meridian $M_2$ at 180 degrees longitude, the sixth face 104*f* is centered over the fourth meridian $M_4$ at 60 degrees East longitude, and the seventh face 104*g* is centered over the sixth meridian $M_6$ at 60 degrees West longitude.

The second, third, and fourth faces 104*b*, 104*c*, and 104*d* are separated from each other by 120 degrees, as are the fifth, sixth, and seventh faces 104*e*, 104*f*, 104*g*, with the northern and southern groups of faces being offset from each other by 60 degrees. As noted above, the second, third, and fourth faces 104*b*, 104*c*, and 104*d* are positioned at about 12 degrees North latitude, which is much lower than the 43 degrees South latitude, where the fifth, sixth, and seventh faces 104*e*, 104*f*, 104*g* are positioned. This difference is due to the presence of the first face 104*a* over the North pole NP, with no corresponding face positioned over the South pole SP. As a consequence of the difference in positions of the northern and southern faces, the spacing between the northern faces is much greater than the spacing between the southern faces, as can be seen in a comparison of FIGS. 2 and 3.

The inventors recognized that the wider lands between the second, third, and fourth faces 104*b*, 104*c*, and 104*d*, relative to those between fifth, sixth, and seventh faces 104*e*, 104*f*, 104*g*, would affect the probabilities of each roll of the die 100. As the die rolls over a smooth, planar surface, there would be a greater probability that the die would roll across the northern hemisphere without stopping on one of the faces, as compared to the probability of stopping on one of the faces in the southern hemisphere. To equalize the probabilities, the inventors introduced the bumps 106. The bumps 106 are positioned between adjacent pairs of the second, third, and fourth faces 104*b*, 104*c*, and 104*d*, and centered over the second parallel $P_2$, at about 23 degrees North latitude. The bumps 106 act as comparators by causing the die 100 to change direction to a moderate extent each time it rolls over a bump, thus effectively narrowing the lands between the northern faces.

Figure 5:
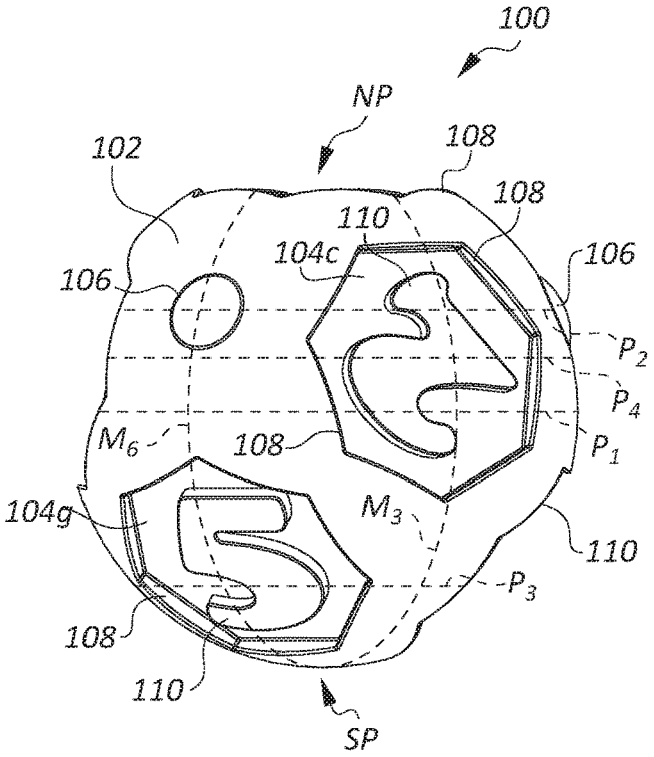
Figure 6:
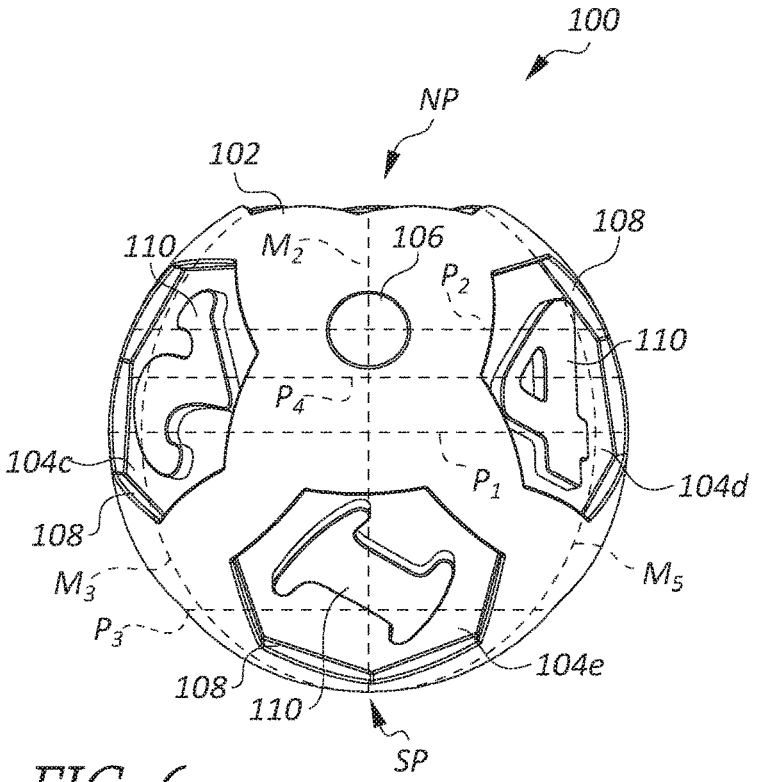
Figure 7:
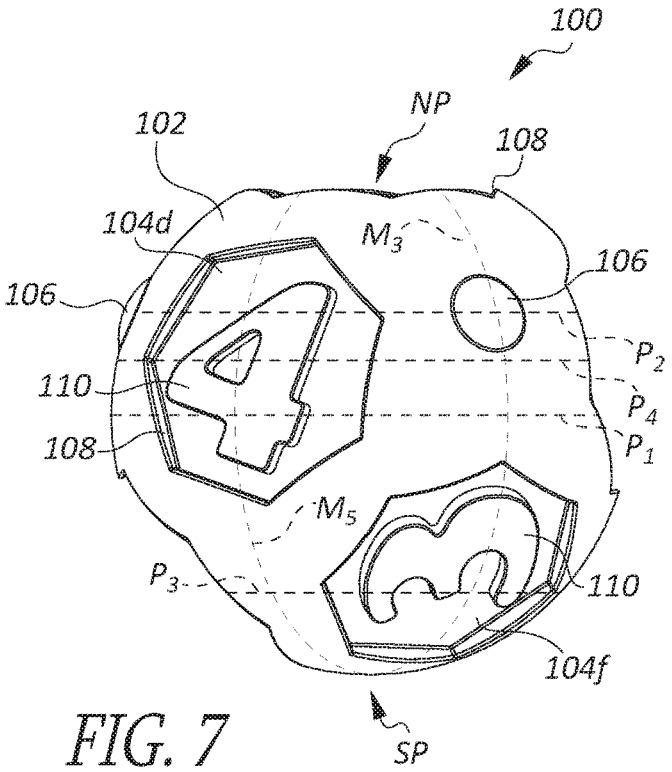

FIG. 8 shows a portion of the die 100 with one of the bumps 106 in a side view, similar to the view of the bump 106 to the right in FIG. 5. FIG. 9 shows a bump 106 as viewed from a point nearly directly over the bump, similar to the view of the bump that is visible in FIG. 6. In FIG. 8, projection lines T are shown tangent to the surface of the bump 106 and also to the surface of the spherical body 102, above and below the bump. It will be recognized that as the die 100 rolls over a bump 106 on a smooth, planar surface, contact between the body 102 and the surface can occur no closer to the bump than a point at which the surface is tangent to both the bump and the body, which is represented by the tangent lines T in FIG. 8. Contact cannot occur within a circular area having a diameter D, except at the apex of the bump 106. Once having reached the limit defined by the diameter D, it either changes direction, or hops over the bump 106 to land on the opposite side. In either case, the likelihood that the die 100 will roll across one of the adjacent faces 104 is greatly increased.

According to various embodiments, there are a number of features that may tend to promote the energetic movement of the die 100 as it rolls. Such features can be modified in the design of a particular class of dice to change the character of motion. In the pictured embodiments, the bumps 106 are about 6.5 mm in diameter, and about 1.25 mm in height, with an arc radius of about 5 mm, or around 30% of the radius of the spherical body 102. If the height and/or relative arc radius of the bumps 106 is changed, this will change the diameter D of the area excluded from contact with the gaming surface, which will, in turn change the behavior of the die 100 as it rolls. The shape of the bumps can also be changed. For example, the bumps 106 in the drawings are semi-spherical, but they can be ovoid, i.e., elliptical in plan view. This will cause the rolling behavior to vary according to the orientation of the bump, relative to the direction of the roll. Other bump shapes that are contemplated include pyramidal and polygonal, i.e., having a point and/or a number of facets.

In the drawings, each of the faces 104 is heptagonal in shape. Accordingly, no two sides of a face 104 are parallel, which reduces the likelihood that the die 100 will be captured by opposing sidewalls 108 of a face 104, causing it to roll in a direction defined by the opposing side walls. Similarly, no two adjacent faces are oriented with their closest sidewalls 108 lying parallel to each other. Thus, as the die 100 rolls so as to cross over a land between two faces 104, each of the sidewalls 108 that define the intervening land will impart a different angular impetus to the roll of the die 100, thereby reducing the predictability of the roll.

If the dimensions of the faces 104 are reduced or enlarged, relative to the size of the die 100, the width of the intervening lands becomes, conversely, wider or narrower, which may result in longer or shorter average roll times.

Various details of the design of the die 100 can be varied to further adjust or modify the behavior of the die 100. For example, if testing reveals that there are slight differences in the likelihoods of arriving at particular faces, the weight of the die can be adjusted to correct such differences. In the embodiment shown in the drawings, the symbols 110 are raised above the faces 104. The weight at a particular face can be increased or reduced by changing the distance by which the symbol on that face extends above the face, compared to the other symbols on the die. Similarly, the depth by which a particular face 104 is recessed into the spherical body 102 can be modified. Reducing the depth of a particular face 104 will result in a greater mass at that location, compared to the other faces, increasing the likelihood that the die 100 will come to a stop on that face.

With respect to the disclosed embodiments, it can be seen from the drawings that none of the faces 104 are positioned directly opposite each other. As a result, when the gaming die 100 is tossed so as to tumble, then land with one face down, no single face will be uppermost on the opposite side. Accordingly, it is most practical to "count" the bottom-most face when determining the outcome of a particular toss. This requires that the user employ some method for identifying that face that is acceptable to all of the participants of a game. According to an embodiment, the surface of the spherical die is printed or incised with small numbers, symbols, or dots representing the symbol on the face directly opposite, enabling the identification of that face without disturbing the die.

Figure 10:
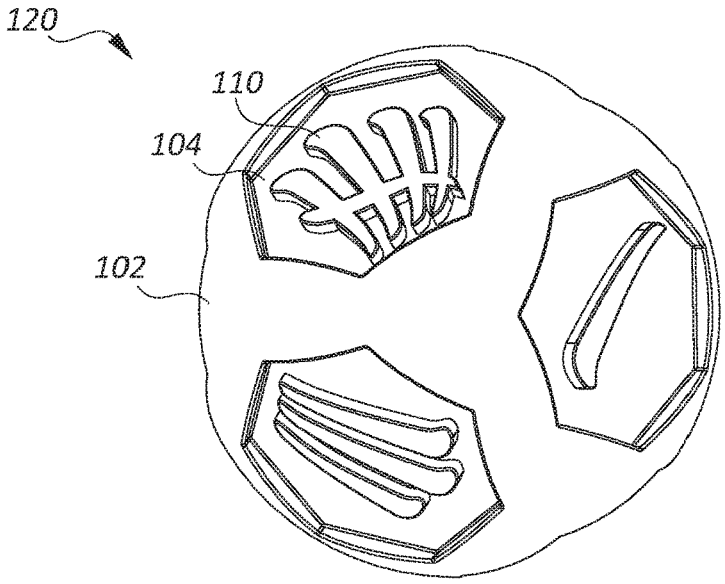
FIGS. 10-12 show examples of other types of symbols that can be used, according to respective embodiments, on gaming dice similar to the die of FIG. 1.
Figure 11:
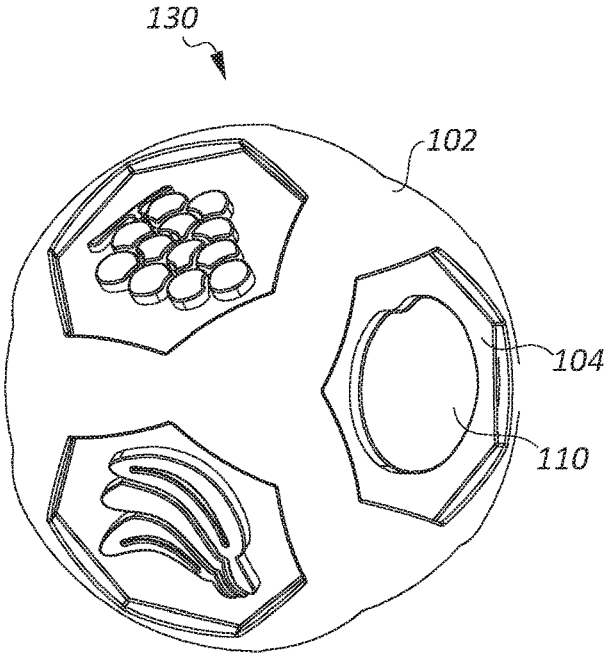
Figure 12:
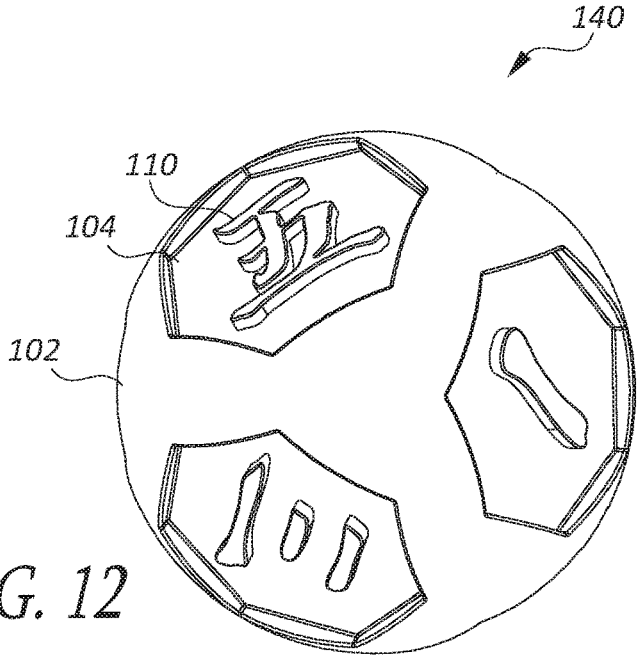

In the embodiment shown in FIGS. 1-7, the symbols 110 are Arabic numerals 0-6. The numbers 1-7 may also be used, or any other combination of numbers and/or letters. In some cases, it may also be advantageous to leave one face blank. FIGS. 10-12 show examples of other types of symbols that may be used. FIG. 10 is a bottom plan view of a gaming die 120 that includes symbols 110 in the form of fanciful "Rohman" numerical characters.

FIG. 11 is a bottom plan view of a gaming die 130 that includes symbols 110 in the form of traditional slot machine tokens, such as cherries, lemons, grapes, bells, etc. It is contemplated that with dice (typically three dice) similar to the gaming die 130 of FIG. 11, a user can play a game that evokes the experience of playing a slot machine. It is further contemplated that, in addition to numerical scoring, coins or other tokens may be distributed manually or mechanically during play, which may also be accompanied by suitable auditory or visual effects.

FIG. 12 is a bottom plan view of a gaming die 140 that includes symbols 110 in the form of Chinese characters. The use of non-Roman alphabet and character sets is contemplated, particularly where a set of dice is to be sold or marketed to a particular ethnic or national group.

In addition to standard characters, it is also contemplated that symbols, numbers, pictograms, or other characters having particular significance can be employed. Numbers, words, colors or symbols associated with good or bad luck; colors, business names or logos, pictures, place-names, advertising images, etc., are among the types of symbols that can be incorporated.

According to another embodiment, identically weighted decal or resin-coated emblem pieces are provided for respective ones of the recesses of a blank die, corresponding, for example, to the faces 104 of the die 100 of FIGS. 1-7. For example, according to an embodiment, an emblem piece bears a dragon-face symbol to be mounted on one of the faces of the die, with Chinese characters for the remaining faces. However it will be understood that other sets of indicia/symbols can likewise be formed and mounted about the surface of a die, e.g., Roman numerals, fruit and other slot machine symbols, other animals, etc., each emblem piece being substantially identical in weight to the others in a set. Each emblem piece has a size and shape that allows it to be set within a corresponding recess formed in the surface of the die at locations as previously described. According to an embodiment, each emblem piece has a seven-sided (heptagonal) outer edge that fits closely within the corresponding seven-sided perimeter of the recess, the thickness of the emblem piece being somewhat less than the height of the recess so that its upper surface is set below the rim of the latter.

The indicia/symbols borne by the emblem pieces may be displayed on or in the pieces. According to an embodiment, the symbol is printed, or otherwise formed, in a suitable color or colors on the upper surface of a base plate, which is then covered by a layer of transparent plastic or other material. According to a further embodiment, the cover layer has a domed upper surface to give the symbol a pleasing "jewel" appearance. A lower side of the base plate includes a layer of adhesive for mounting to the die; it will be understood that an adhesive may also be applied at other locations during the assembly process, and that alternative mechanisms can be employed to affix the emblem piece to the die.

According to an embodiment, the balance of the die body is "fine tuned" to ensure that the center of mass is correctly zeroed, for example, by raising/lowering the bottom surfaces of the recesses or by removing (e.g., drilling) or adding material to the bottom surfaces at locations that will subsequently be covered by the emblem pieces. The emblem pieces then can then be installed by being rotated to the correct orientation relative to the die body—e.g., by referring to indicators provided in the recesses—and then inserted into the recess with the base plate disposed downwardly so that the adhesive layers form an engagement with the bottom surface. Thus installed, the upper surface of the emblem piece is depressed or spaced a distance below the perimeter rim, so that the rolling and play action of the die will be substantially the same as previously described. Since the emblem pieces are uniformly weighted, the center of gravity of the blank original die body will remain unaffected and correctly located.

Embodiments are also contemplated in which other design elements are varied, including, for example, the shape of the faces, as well as their relative orientation and their arrangement on the spherical body.

Figure 13:
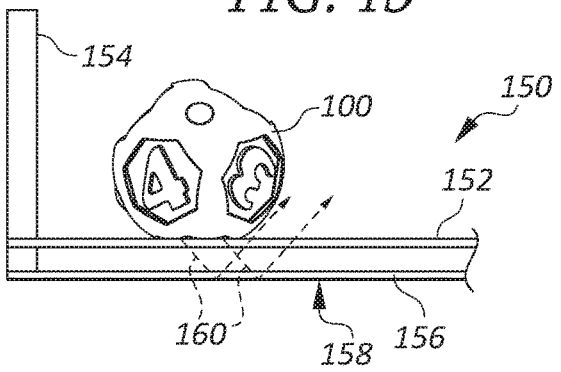
FIGS. 13-15 are side elevation views of gaming surfaces, according to respective embodiments.
Figure 14:
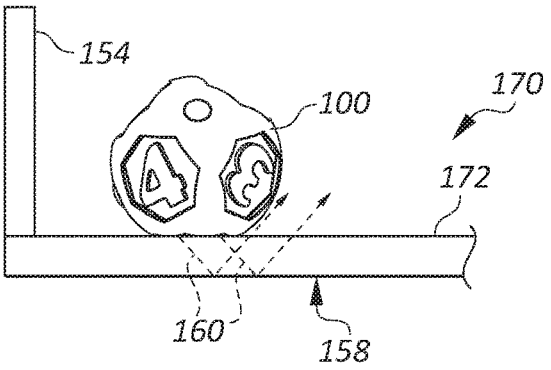

FIG. 13 is a side elevational view of a gaming surface 150, according to an embodiment, with a gaming die 100, positioned thereon. The gaming surface 150 includes a first layer 152 that is made of a transparent material, such as, e.g., glass, acrylic, polycarbonate, etc. A bumper rail 154 is shown, as may be provided to contain dice that are thrown onto the gaming surface 150. A second layer 156 with a mirrored surface 158 is positioned parallel to, and directly below the first layer 152, at a distance that is sufficient to provide a clear view of the bottom of the die—more than about one quarter the diameter of the die 100, for example. When the die 100 is tossed onto the gaming surface 150, it eventually comes to rest with one of the seven faces lying against the gaming surface, and it becomes a simple matter of looking at the reflection 160 in the mirrored surface 158 to identify the bottom-most face. FIG. 14 shows a gaming surface 170, according to an alternate embodiment, that includes a single transparent layer 172 with a mirrored face 158 on the side opposite the gaming face. The material of the gaming surface 150 is sufficiently thick—around one-quarter the diameter of the die—that the "hidden" face can be easily viewed in the mirrored image 160. A material thickness of around 9 mm (about ⅜ of an inch) or greater is adequate to read the hidden face of a 36 mm die. To further facilitate this method, according to an embodiment, the symbols on each face may be presented as mirrors of the actual symbols, so that they become "right-reading" when viewed in the mirrored surface.

Figure 15:
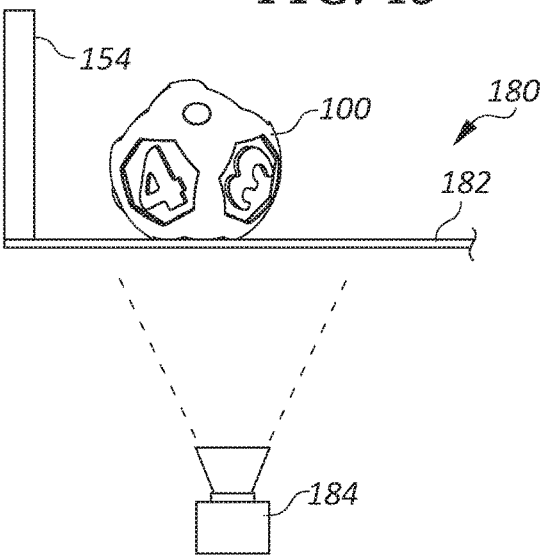

FIG. 15 is a side elevational view, according to another embodiment, of a gaming surface 180 that includes a single transparent layer 182, and a video camera or other 2D or 3D imaging device 184 is positioned on the side opposite, so that when a tossed die 100 comes to rest, the bottom-most face is within range of the camera. A 2D video screen or possibly a holographic or other 3D projection showing the captured image may be positioned within view of the players and/or spectators.

According to a further embodiment, each face 104 of the die 100 is provided with a machine-readable encoding, in addition to, or instead of the visible symbols. The gaming surface is provided with one or more sensors configured to detect the bottom-most face of a tossed die. A display is provided on which the results of a toss are shown, in real time.

In the drawings, some elements are designated with a reference number followed by a letter, e.g., "104*a*, 104*b*." In such cases, the letter designation is used where it may be necessary in the corresponding description to refer to or differentiate between specific ones of a number of otherwise similar or identical elements. Where the description omits the letter from a reference, and refers to such elements by number only, this can be understood as a general reference to the elements identified by that reference number, unless other distinguishing language is used.

Ordinal numbers, e.g., first, second, third, etc., are used in the claims according to conventional claim practice, i.e., for the purpose of clearly distinguishing between claimed elements or features thereof. The use of such numbers does not suggest any other relationship, e.g., order of operation or relative position of such elements, etc. Furthermore, an ordinal number used to refer to an element in a claim does not necessarily correlate to a number used in the specification to refer to an element of a disclosed embodiment on which that claim reads, nor to numbers used in unrelated claims to designate similar elements or features.

The various embodiments described above can be combined to provide further embodiments. All of the U.S.

patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A gaming die, comprising:

a spherical body;

an odd number of substantially planar faces, distributed around the die, the spherical body defining lands extending between pairs of the plurality of faces;

a plurality of bosses positioned on the spherical body between respective pairs of the plurality of faces;

wherein lands extending between adjacent pairs of three of the odd number of substantially planar faces are wider than lands extending between adjacent pairs of the others of the odd number of substantially planar faces; and wherein each of the plurality of bosses is positioned on one of the wider lands.

2. The gaming die of claim 1 wherein the gaming die includes exactly seven faces, comprised by the odd number of faces; and the gaming die includes exactly three bosses, comprised by the plurality of bosses.

3. The gaming die of claim 1 wherein the gaming die includes exactly three bosses, comprised by the plurality of bosses.

4. The gaming die of claim 1 wherein each of the odd number of faces is in the shape of a regular polygon.

5. The gaming die of claim 4 wherein each of the odd number of faces is heptagonal in shape.

6. The gaming die of claim 1 wherein each of the odd number of faces has an equal surface area.

7. The gaming die of claim 1 wherein each of the odd number of faces is recessed into the generally spherical body, such that a side wall extends from the face to a surface of the spherical body around a perimeter of the respective face.

8. The gaming die of claim 1 wherein each of the odd number of faces comprises a respective symbol that is distinct, relative to symbols of the others of the plurality of faces.

9. The gaming die of claim 8 wherein the respective symbol comprised by each of the faces is one of: an Arabic numeral, Roman numeral, Chinese character, traditional gambling symbol, business logo, or pictogram.

10. The gaming die of claim 1 wherein each of the odd number of faces comprises a machine-readable code by which each ace can be distinguished from the others of the odd number of faces.

11. The gaming die of claim 1 wherein each of the plurality of bosses has a semi-spherical shape.

* * * * *